United States Patent [19]

Cotter

[11] Patent Number: 4,706,434

[45] Date of Patent: Nov. 17, 1987

[54] STANDING SEAM STRUCTURE COVERING SYSTEM

[75] Inventor: Donald P. Cotter, Livermore Falls, Me.

[73] Assignee: Alumax Inc., Mesquite, Tex.

[21] Appl. No.: 834,702

[22] Filed: Feb. 28, 1986

[51] Int. Cl.[4] ..... E04D 1/00

[52] U.S. Cl. ..... 52/520; 52/528; 52/545; 52/478

[58] Field of Search ..... 52/478, 519, 520, 528, 52/530–533, 535, 538, 544, 545, 549, 551, 552, 553, 459–464, 469

[56] References Cited

U.S. PATENT DOCUMENTS

| | | | |
|---|---|---|---|
| 102,441 | 4/1870 | Siddons | 52/420 |
| 631,092 | 8/1899 | Reese | 52/420 |
| 3,889,437 | 6/1975 | Day et al. | 52/520 |
| 4,114,340 | 9/1978 | Dean et al. | 52/520 |
| 4,184,299 | 1/1980 | East | 52/463 |
| 4,213,282 | 7/1980 | Heckelsberg | 52/404 |
| 4,463,533 | 8/1984 | Mullet | 52/394 |
| 4,570,404 | 2/1986 | Knudson | 52/520 |

OTHER PUBLICATIONS

1985 Sheetmetal and Air Conditioners Contractors National Association Manual, plates 85, 86 and 87.

Jun. 1985 Contractors Guide, p. 25.

KMF Heavy Duty Standing Seamer sales brochure, distributed by Custom Manufacturing Corporation, Tomlinson and Franks Road, Huntingdon Valley, Pa. 19006.

*Primary Examiner*—John E. Murtagh

*Assistant Examiner*—Andrew Joseph Rudy

*Attorney, Agent, or Firm*—Townsend and Townsend

[57] ABSTRACT

A standing seam system includes parallel, elongate panels having first and second upstanding, interconnected edges forming a standing seam. The edges include spaced-apart upstanding portions and outer end portions. The outer end portions are folded together to form a lockseam. The outer surfaces of the lockseam and upstanding portions are generally coplanar to provide a uniform appearance and effectively conceal the lockseam. A portion of the panel between the pan section and the second edge is formed to create an upwardly extending bi-fold interior hem in the space between the first and second edges. This interior hem is engaged by brackets secured to the structure at appropriate positions to anchor the panel to the structure. Since the brackets only extend part way up the edges and do not extend into the lockseam, the lockseam is smoother and much more water tight than it would be otherwise.

11 Claims, 3 Drawing Figures

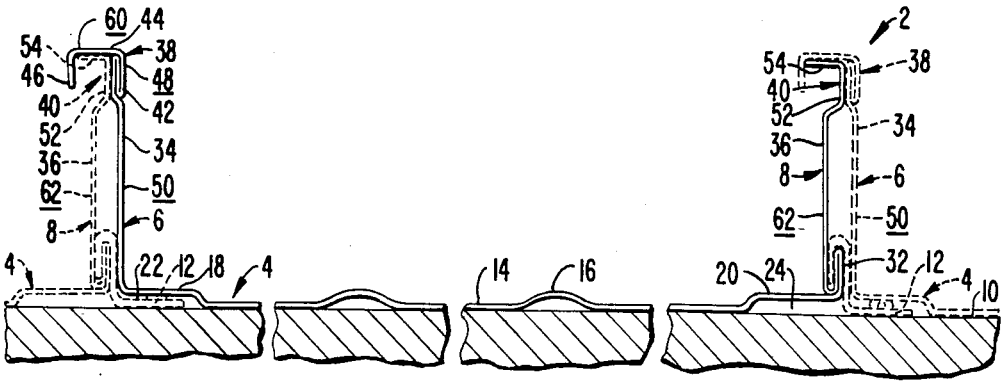
FIG._1.
FIG._2.
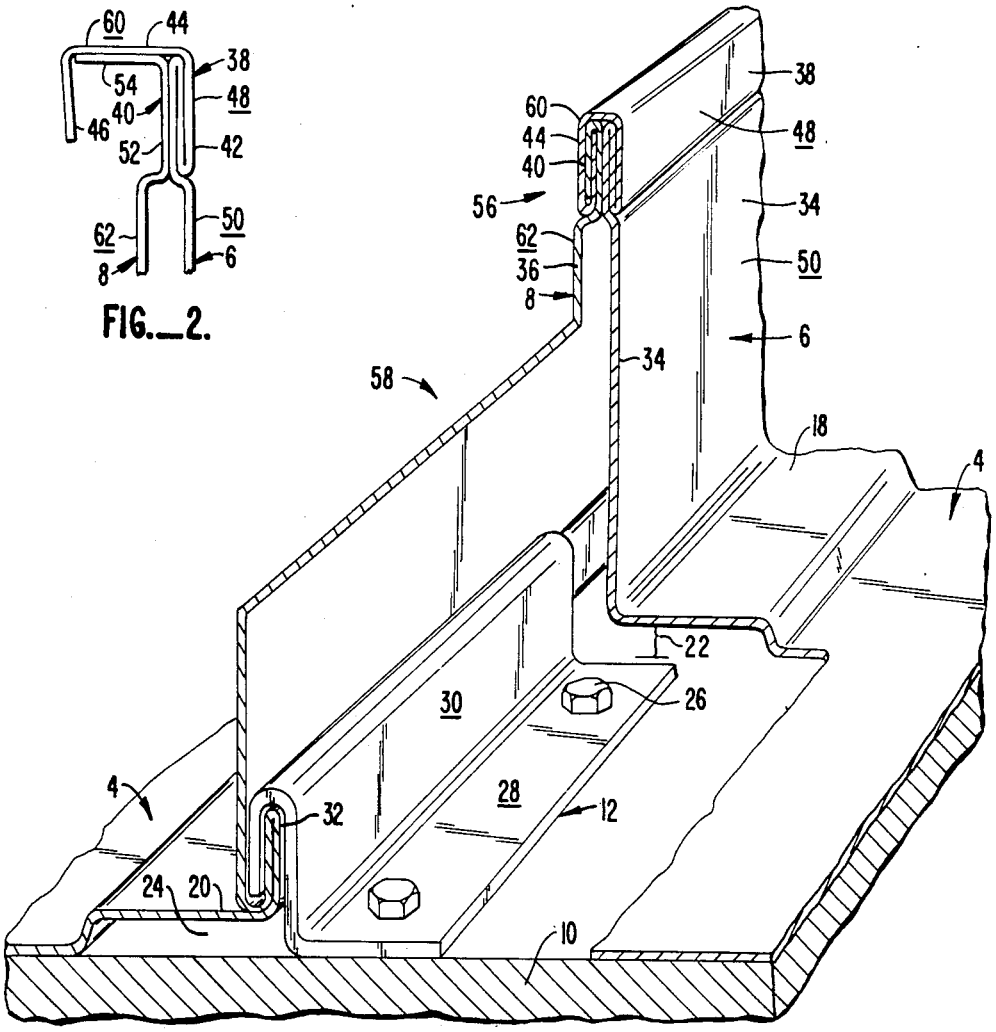
FIG._3.

STANDING SEAM STRUCTURE COVERING SYSTEM

BACKGROUND OF THE INVENTION

Standing seam metal roofs have been in existence for hundreds of years. This roofing system uses panels having a generally flat pan portion and upstanding lateral edges. The upper ends of the adjacent edges are usually folded over into what is called a double lockseam. Standing seam roofs are commonly secured to the structure in one of two ways. One way, as shown in U.S. Pat. No. 102,441, drives screws or other fasteners through the pan. This has the disadvantage of providing a place for leaks and also limits the length of the pan because of thermal expansion and contraction. More commonly cleats or brackets are used to secure the panels to the structure. Conventional cleats are secured to the structure at their lower ends and have their upper ends folded into the lockseam when the double lockseam is formed thus fastening the panels to the structure.

The double lockseam of standing seam roofing systems were initially made by the roofing artisan using metal tongs or hand seamers and mallets. In the early 1970's several manufacturers developed and sold manual or power driven seaming machines for accomplishing this. One such standing seamer is sold by KMF Equipment Corporation of Huntington, Pennsylvania. Such powered seamers have effectively replaced hand seaming.

Most, if not all, roofing panels are now manufactured by roll forming machines. Factory manufactured roofing systems usually include panels supplied in 40 foot lengths, the length of common carriers. Alternatively, the panels can be formed in continuous lengths at the job site using mobile roll formers. In either event, thermal expansion and contraction of these relatively long panels must be accommodated by the method of attachment of the panels to the roof. One system, designed for ease of installation and for accommodating the thermal expansion and contraction which arises with the longer length panels, is made by Butler Manufacturing of Kansas City, Mo., and is sold as the MR-24 System and Clip. Another system, also designed to allow for some thermal movement, is shown in U.S. Pat. No. 4,184,299 to East. The Butler system employs the double lockseam while East uses a separate snap-on cap. The amount of movement permitted with the East system is determined by the length of the slot and the bracket.

There is a problem common to standing seam roofing systems which by their design do not create a seamed or folded region, such as the system shown in the East patent or U.S. Pat. No. 4,114,340 to Dean, et al. The lack of a lockseam creates a joint between the panels that is at best difficult to seal effectively. Under packs of snow or ice or in the event of wind driven rain, capillary action can allow moisture to be drawn up and over the vertical flange and into the void between the panel. The double lockseam of conventional standing seam roofing systems substantially eliminates this problem. To create the tightest joint, it is desirable to fold or form the metal as close to the hold down bracket or clip (which is folded into the standing seam) as is possible. This helps prevent water infiltration by capillary action. However, there are always small voids at the edges of the brackets which are sites for possible capillary action. To prevent this, sealants can be used, such as shown in the patent to Siddons. Although double locked standing seams eliminate much of the problems due to water infiltration due to capillary action, and although use of sealants can effectively control the problem of leakage at the hold down brackets, the intermittent positioning of the cleat or bracket causes a bulge or bump along the standing seam. This is not only visually unappealing, it also causes pre-painted surfaces to crack or split which lowers the aesthetic appeal of the roofing system and reduces somewhat the protective value of the paint.

SUMMARY OF THE INVENTION

Applicant's invention is directed to a standing seam structure covering system which is simple to manufacture and install, eliminates the problems caused by having the cleat or bracket interlocked into the upper lockseam of the panels while permitting virtually unlimited longitudinal movement due to thermal expansion and contraction. Although the system can be used to cover various surfaces of a structure, including side walls and roofs, its most common application will be as a roofing system. For convenience the invention will usually be described in terms of a roofing system but its applicability is not so limited.

The standing seam roofing system includes elongate panels having first and second upstanding edges on either side of a pan section which lies against a surface of the structure. The first edge of one panel lies parallel to and adjacent the second edge of an adjacent panel and is interconnected therewith to form a standing seam. The first and second edges both include upstanding portions and outer end portions. The outer end portions are folded together to form a lockseam. The edge outer portions are sized so that when the lockseam is created the width of the lockseam is substantially greater than the combined thicknesses of the upstanding portions. The outer end and upstanding portions are joined so that the outer surfaces of the lockseam and the upstanding portions are generally coplanar on each side of the standing seam. The upstanding portions are thus spaced apart sufficiently to provide a uniform appearance so to effectively conceal the double lockseam. The increased thickness of the lockseam makes the standing seam quite rigid for long span structural strength. In the preferred embodiment, made from formed sheet metal, the lockseam is seven layers thick.

A portion of the panel between the pan section and one of the edges is formed to create an upwardly extending interior lip. The interior lip lies between the first and second edges. When the panels are formed from sheet metal, as in the preferred embodiment, the interior lip is a bi-fold interior hem. The interior lip is engaged by brackets secured to the structure at appropriate positions to anchor the edge of the panel to the structure. The space between the upstanding portions is sufficient to house the interior lip and the portion of the brackets engaging the lip.

A portion of the pan section adjacent one of the edges is offset to create a clearance cavity for the base of the bracket. A similar offset portion can be formed in the pan section adjacent the bottom of the other edge so the structure has a balanced look. Providing two clearance cavities also permits a bracket to be mounted on either side of the standing seam. Since the bracket only extends part way up the edges and does not extend into the lockseam, the lockseam is smooth and is quite water tight without the need to use sealants.

The increased thickness of the lockseam, in addition to creating a smooth appearance on either side of the standing seam, provides additional strength for the standing seam so that after installation a truss effect occurs. This increase in structural strength permits panels to span greater distances between the structural framing members of the structure than would otherwise be possible. Structural framing at increased intervals can save significant amounts of money. The increased lockseam thicknesses at the upper lockseam also helps the standing seam to withstand physical damage from workmen, ladders, equipment and so forth.

The standing seam roofing system is also quite pleasing because the standing seam has a balanced look with smooth lines. The unbalanced impression of conventional standing seam roofing systems, created by the lockseam being folded to one side, is eliminated.

The simplicity of the hold down bracket and its mating vertical interior lip adds to the effectiveness of the system. The present system eliminates the practice of having the bracket or cleat being folded into the upper lockseam of the system so that distortion, paint cracking, surface deformation and associated leaking are eliminated. Although the lockseam of the invention can be used with a sealant, since it is uninterrupted by any physical object, such sealant should not be necessary. This further adds to the simplicity of installation so to help reduce overall costs. In addition, since clips or cleats are not folded into the lockseam, conventional manual and mechanical seamers do not have to clear the extra thickness of the clip. This permits heavier gauge roofing panels to be seamed, thus permitting increased structural strength and length of spans.

The hold down system is simple, yet effective. The interior lip is both strong but also has no gaps or interfaces which could permit water to seep under the panel. The anchorage is positive and secure and yet permits necessary thermal movement using an elegantly simple design.

The simplistic nature of the design reduces the number of components to two: the panel and the bracket. Installation costs due to labor are minimized due to the simplistic nature of the design. Complex components, used with many of the prior art anchoring systems, are eliminated thus providing further savings.

Other features and advantages of the present invention will appear from the following description in which the preferred embodiment has been set forth in detail in conjunction with the accompanying drawings.

BRIEF DESCRIPTION OF THE DRAWINGS

FIG. 1 is a side view of a standing seam roofing system made according to the invention with panels placed adjacent one another prior to seaming with hold down brackets in place.

FIG. 2 is an enlarged side view of the outer portions of two abutting panels of FIG. 1 prior to seaming.

FIG. 3 is an oblique view showing a portion of the system of FIG. 1 after seaming.

DETAILED DESCRIPTION OF THE PREFERRED EMBODIMENT

Referring now to the figures, a standing seam roofing system 2 is shown to include broadly a number of elongate panels 4 secured to one another along their upstanding first and second edges 6, 8 to a support structure 10 by a number of hold down brackets 12. When placed on structure 10 (which proceeds left to right in FIG. 1), panels 4 are in the preformed but unseamed condition shown in FIG. 1. Panels 4 include a generally flat or planar pan section 14 between first and second edges 6, 8. Pan section 14 includes several longitudinal ridges 16, for added strength, and first and second bracket offset portions 18, 20 adjacent first and second edges 6, 8. Portions 18, 20 define bracket cavities 22, 24 which provide space for brackets 12 and their associated screws 26.

Brackets 12 have a generally horizontal portion 28, through which screws 26 pass for engagement into support structure 10, and an upstanding, generally U-shape portion 30 sized to fit over an upwardly extending, bi-fold interior lip or hem 32. Hem 32 is an extension of panel section 4 between second bracket offset portion 20 and second edge 8. Prior to seaming, system 2 appears as in FIG. 1 with only second edge 8 of panels 4 secured to support structure 10.

First and second edges 6, 8 each include first and second upstanding portions 34, 36 and first and second outer portions 38, 40, respectively. First outer portion 38 includes a tri-fold, offset first seam portion 42, a second seam portion 44 and a third, outermost seam portion 46. The offset of first seam portion 42 is sufficient so that an outer surface 48 of portion 42 is generally coplanar with an outer surface 50 of first upstanding portion 34. Second outer portion 40 includes a fourth, offset seam portion 52 and a fifth seam portion 54. After seaming, using conventional techniques, first and second edges 6, 8 go from the configuration of FIG. 2 to the configuration to FIG. 3 in which first and second outer portions 38 are folded or creased together to form a seven layer double lockseam 56. Upstanding portions 34, 36 and outer portions 38, 40 combine to form a standing seam 58. Fourth seam portion 52 is offset sufficiently so that the outer surface 60 of second seam portion 44 is generally coplanar with the outer surface 62 of second upstanding portion 36. Since brackets 12 do not extend within lockseam 56, surfaces 48, 60 are smooth and uninterrupted along the length of lockseam 56.

Roof system 2 has smooth, clean lines, can easily be made water tight, is simply and securely fastened to support structure 10 and uses only two simple components.

In use, the user positions a panel 4 on support structure 10, typically a roof or sidewall of a building, and secures it in place using brackets 12 engaging hem 32. The first edge 6 of another panel 4 is positioned against the second edge 8 of the pre-positioned panel so that second seam portion 44 overlies fifth seam portion 54. Once properly positioned, a conventional seamer is used to create double lockseam 56 as shown in FIG. 2.

Modification and variation can be made to the disclosed embodiment without departing from the subject of the invention as defined in the following claims. For example, an upwardly extending, bi-fold interior hem 32 may be formed at the base of first edge 6 rather than second edge 8, if desired. It is generally not necessary to provide second bracket offset portion 20. However, doing so makes system 2 look symmetrical and also permits brackets 12 to extend part way under portions 20. Although sealants are generally not needed at double lockseam 56, they can be used if desired. The preferred embodiment has been shown using sheet metal panels 4. It may be desired to make panels 4 out of other materials, such as extruded or formed plastic. In such case, the extra thickness at lockseam 56 may be created not by folding over multiple layers of material, as in the tri-fold seam portion 42, but by simply providing thickened regions at the upper ends of the edges. If the panel edges are of an appropriate plastic, they may be jointed by fusion, such as using heat or ultrasonic techniques, or may be joined using an adhesive. This may eliminate the need for a folded lockseam.

I claim:

1. A standing seam structure covering system comprising:

a plurality of elongate, parallel panels each having first and second parallel, upstanding edges, the first edge of one panel interconnected with the second edge of an adjacent panel;

said first and second edges including upstanding portions and end portions, said end portions joined together to form a seam having a thickness substantially greater than the combined thicknesses of the first and second upstanding edges, the first and second upstanding edges spaced apart from one another by a chosen distance to create a cavity therebetween;

said end portion of said first edge including first, second and third seam portions, said end portion of said second edge including fourth and fifth seam portions, said seam portions creating an uninterrupted lockseam with said fourth seam portion between said first and third seam portions and said fifth seam portion between said second and third seam portions;

said panels including an upwardly extending, multiple thickness internal hem extending into the cavity; and a plurality of brackets secured to the structure, each of the brackets having a portion sized for engaging said internal lip so to secure the interlocked panels to the structure.

2. A standing seam structure covering system comprising:

a plurlity of elongate, parallel planes each having first and second parallel, upstanding edges, the first edge of panel interconnected with the second edge of an adjacent panel;

said first and second edges including upstanding portions and end portions, said end portions joined together to form a seam having a thickness substantially greater than the combined thicknesses of the first and second upstanding edges, the first and second upstanding edges spaced apart from one another by a chosen distance to create a cavity therebetween;

said panels including an upwardly extending internal lip extending into the cavity; and a plurality of brackets secured to the structure, each of the brackets having a portion sized for engaging said internal lip so to secure the interlocked panels to the structure, the brackets configured so as not to extend within the seam.

3. The system of claim 1 wherein the panels include bracket clearance portions, adjacent at least one of said first and second edges, defining a clearance cavity between the panel and the structure to accommodate the brackets.

4. The system of claim 3 wherein the panels include bracket clearance portions at both of said first and second edges.

5. The system of claim 1 wherein the first seam portion is a tri-fold seam portion.

6. The system of claim 1 wherein the outer surfaces of the upstanding portions are generally coplanar with outer surfaces of adjacent end portions.

7. The system of claim 1 wherein the fourth seam portion is offset sufficiently so an outer surface of the second seam portion is generally coplanar with the outer surface of the second edge upstanding portion.

8. The system of claim 7 wherein the first seam portion is a tri-fold seam portion having an outer surface, the tri-fold seam portion being offset sufficiently from the first edge upstanding portion so an outer surface of said first edge upstanding portion is generally coplanar with the tri-fold seam portion outer surface, whereby a standing seam, formed by the end and upstanding portions, has a generally constant thickness while the seam portions add to the deflection strength of the panels.

9. The system of claim 1 wherein the second edge defines the internal lip.

10. The system of claim 1 wherein the internal lip is at an end of the upstanding portion farthest away from the end portion.

11. A standing seam system for covering a structure comprising:

elongate panels having pan sections and first and second edges on either side of the pan sections, the first edge of one panel adjacent and secured to the second edge of an adjacent panel to create a standing seam;

the first and second edges having spaced-apart upstanding portions extending from the pan sections and folded outer end portions;

the first edge outer end portion including an upwardly extending tri-fold first seam portion offset from the upstanding portion so an outer surface thereof is generally coplanar with an outer surface of the upstanding portion, the first edge outer end portions also including a downwardly extending second seam portion and an upwardly extending third seam portion;

the second edge outer end portion including an upwardly extending, offset fourth seam portion between the first and third seam portions and a downwardly extending fifth seam portion between the second and third seam portions, the offset of the fourth seam portion sized so the outer surface of the second seam portion is generally coplanar with an outer surface of the second edge upstanding portion;

the panels including a multiple fold, upwardly extending internal hem formed as a continuous member between the pan section and the upstanding portion of a chosen one of the first and second edges, the internal hem positioned between the first and second edges;

brackets, secured to the structure at positions below the standing seam, with interior hem engaging portions, the bracket sized so an uppermost portion thereof lies below the outer end portions of the first and second edges; and the panels having bracket clearance portions sized to provide clearance cavities between the panels and the structure for receipt of a portion of the brackets.

* * * * *